US006237385B1

(12) United States Patent
Stodt

(10) Patent No.: US 6,237,385 B1
(45) Date of Patent: May 29, 2001

(54) METHOD OF COOLING A ROLLED STOCK AND A COOLING BED FOR EFFECTING THE METHOD

(75) Inventor: Rolf Stodt, Kaarst (DE)

(73) Assignee: SMS Schloemann-Siemeg AG, Düsseldorf (DE)

( * ) Notice: Subject to any disclaimer, the term of this patent is extended or adjusted under 35 U.S.C. 154(b) by 0 days.

(21) Appl. No.: 09/551,338

(22) Filed: Apr. 18, 2000

(30) Foreign Application Priority Data

Apr. 20, 1999 (DE) ..... 199 17 725

(51) Int. Cl.[7] ..... B21B 27/06
(52) U.S. Cl. ..... 72/201
(58) Field of Search ..... 72/201, 202, 40, 72/39, 236, 200

(56) References Cited

U.S. PATENT DOCUMENTS 3,479,853 * 11/1969 Berry ..... 72/201
3,533,261 * 10/1970 Hollander et al. ..... 72/201
3,604,234 * 9/1971 Hinrichsen et al. ..... 72/201
5,701,775 * 12/1997 Sivilotti et al. ..... 72/201

* cited by examiner

*Primary Examiner*—Rodney A. Butler
(74) *Attorney, Agent, or Firm*—Brown & Wood, LLP

(57) ABSTRACT

A method of cooling a rolled stock and including providing a cooling bed having entrance, middle, and end sections, transporting the rolled stock along the cooling bed in a direction transverse to the rolled stock longitudinal axis, air-cooling of the rolled stock in the entrance section of the cooling bed, spray-cooling of the rolled stock in the middle section of the cooling bed by spraying water onto the rolled stock, and air-cooling and air-drying of the rolled stock in the end section of the cooling bed.

9 Claims, 1 Drawing Sheet

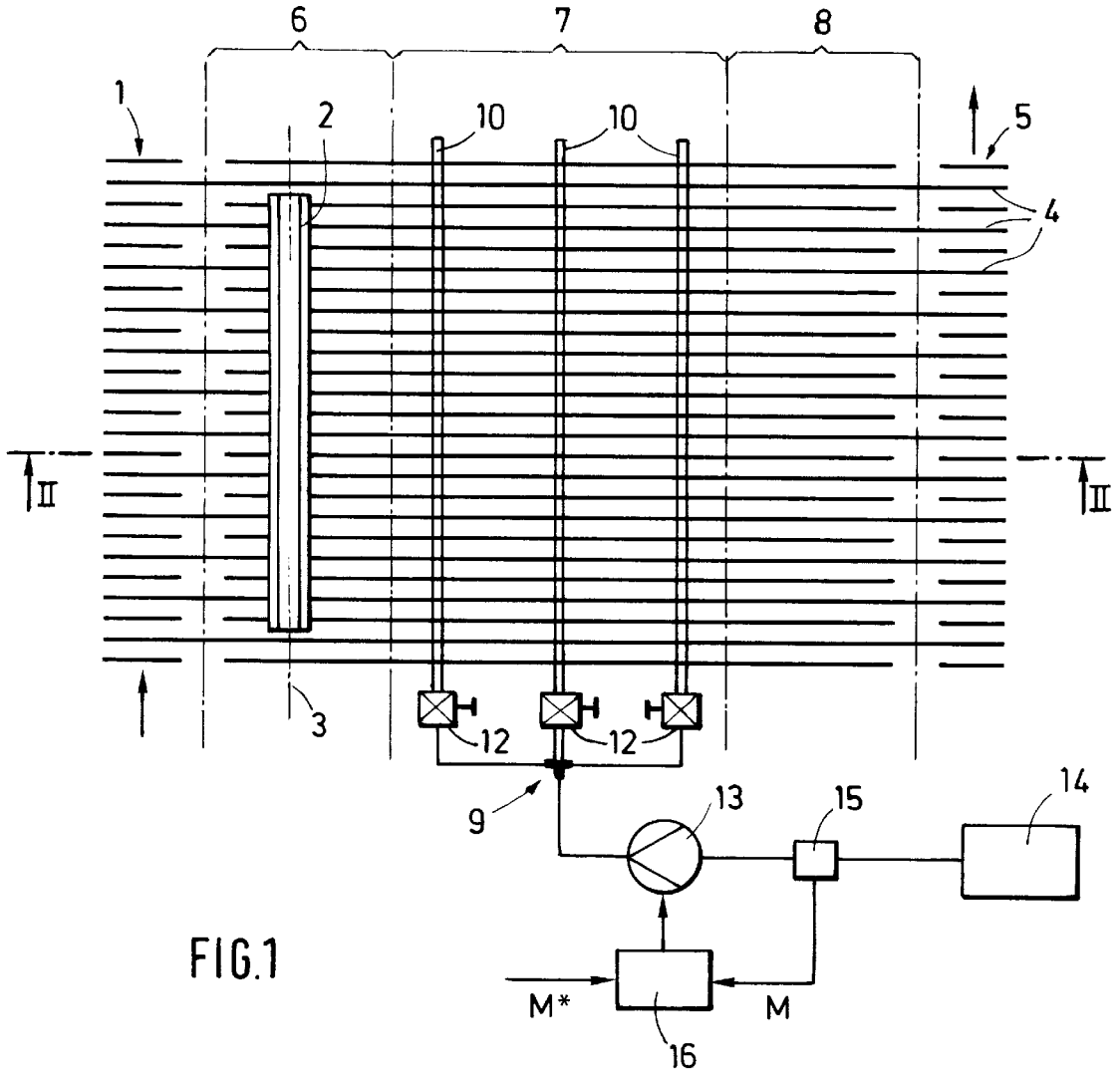
FIG.1
FIG.2
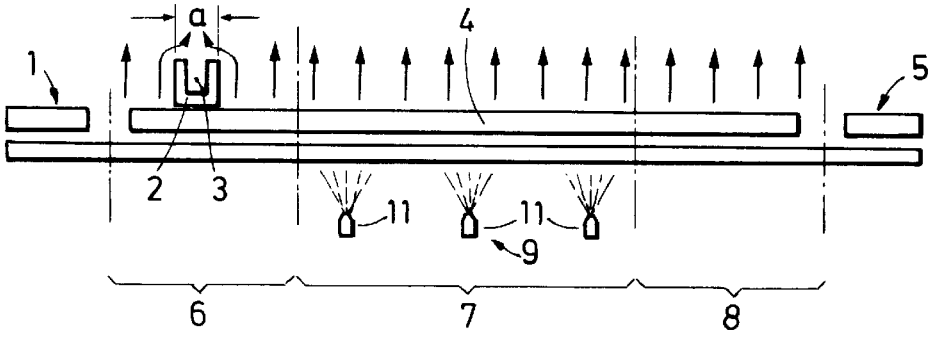

METHOD OF COOLING A ROLLED STOCK AND A COOLING BED FOR EFFECTING THE METHOD

BACKGROUND OF THE INVENTION

1. Field of the Invention

The present invention relates to a method of and a bed for cooling a rolled stock having a longitudinal axis, wherein the rolled stock is transported, during cooling, transverse to the longitudinal axis and is cooled with water having a predetermined working pressure.

2. Description of the Prior Art

An above-mentioned cooling method and a cooling bed are disclosed, e.g., in German Publication DE-OS 1 602 169.

For cooling a rolled stock in a cooling bed essentially two methods are used, namely, either a pure air-cooling or water-cooling.

Air-cooling is rather ineffective and necessitates a large width of the cooling bed. Such cooling beds are rather expensive. Further, in order to insure a uniform cooling, the rolled stock need be rotated during its transportation transverse to its longitudinal axis. During its rotation, the rolled stock even partially extends perpendicular to the cooling bed and then again is laid down.

During water-cooling, as a rule, water from spray nozzles is sprayed onto the rolled stock from beneath and/or from above. The conventional cooling can be conducted only in the rear portion of the cooling bed where coarse water-cooling does not adversely affect the quality of the rolled stock. In addition, the still wet rolled stock need be dried before entering a straightening device arranged downstream of the cooling bed.

Accordingly, an object of the present invention is to provide a method of and a bed for cooling a rolled stock which does not adversely affect the quality of the rolled stock.

Another object of the present invention is to provide a method of and a bed for cooling a rolled stock which permits us to keep the width of the cooling bed relatively small.

SUMMARY OF THE INVENTION

These and other objects of the present invention, which will become apparent hereinafter, are achieved by providing a method for cooling a rolled stock according to which the rolled stock is air-cooled in the entrance section of the cooling bed, then spray-cooled in the middle section of the cooling bed by spraying water onto the rolled stock, and finally is again air-cooled and is air-dried in the end section of the cooling bed; and by providing a cooling bed including conveyor means for transporting the rolled stock along the cooling bed starting from the entrance section and across the middle and end sections, and a water distribution device arranged in the middle section and formed as a spraying device for producing a water mist. The term "mist" means that the water is applied to the rolled stock not in the form of jets, but rather in a form of finest water droplets in form of a mist surrounding at least partially the rolled stock. The finest droplets or atomized water particle can be obtained with appropriately formed spray nozzles, with or without compressed air.

The cooling intensity can be controlled by adjusting the operational width of the middle section of the cooling bed, and/or the quantity of water applied to the rolled stock, and/or the working pressure of the water.

When the water is sprayed onto the rolled stock only from beneath, a free access to the cooling bed from above is retained. The excess amount of water can be carried off upward by an ascending convection current.

The inventive cooling process insures mild cooling of the rolled stock. Moreover, the inventive cooling process provides for temperature equalization inside the rolled stock, in particular between the cooled bottom side of the rolled stock and its upper region. Moreover, the cooling can be conducted in as high temperature range as with splash water cooling. The residual heat of the rolled stock can be used for drying in the end region. It is not necessary any more to rotate the rolled stock as it is conveyed transverse to its longitudinal axis.

When the rolled stock is transported with a walking beam conveyor, the cooling method is particularly reliable. In this case, the cooling bed can be made particularly robust, and the bed have a long service life. However, other transporting means can also be used, e.g., rack or chain conveyors.

The inventive cooling process can be used for different sizes of rolled stocks. However, it can advantageously used for cooling medium and heavy steel profiles.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show:

FIG. 1 a schematic view of a cooling bed according to the present invention; and FIG. 2 a schematic cross-sectional view of the cooling bed shown in FIG. 1 along line 11—11.

DETAILED DESCRIPTION OF THE PREFERRED EMBODIMENT

A cooling bed according to the present invention, which is shown in FIGS. 1–2, has a run-in roller table 1 for delivering a rolled stock 2 having a longitudinal axis 3. Then, the rolled stock 2 is taken over by a conveyor 4 which transports the rolled stock 2 to a run-out roller table 5. The rolled stock 2 is conveyed transverse to its longitudinal axis 3.

The above-described structure of the cooling bed can, of course, be varied. E.g., instead of roller tables 1,5 other run-in and run-out transporting devices can be used.

In the embodiment of the cooling bed described herein, the conveyor 4 is formed as a continuous walking beam conveyor. The walking beam conveyor 4 can be formed of several walking beam sections. Other, then walking beam, types of conveying means can be used for transporting the rolled stock 2 transverse to the longitudinal axis 3 of the rolled stock 2. E.g., the conveyor 4 can be formed as a rack or chain conveyor. Also, a combination of different types of conveying means can be sued. E.g., a walking beam conveyor can be used in one section of the cooling bed, and a chain conveyor can be used in the following section of the cooling bed. However, the use of only walking beam conveyors for transporting the rolled stock 2 transverse to the longitudinal axis of the rolled stock is preferred.

During its transportation transverse to its longitudinal axis, the rolled stock 2 passes through entrance section 6, middle section 7, and end section 8 of the cooling bed.

When the rolled stock 2 passes through the entrance section 6, the rolled stock 2 is still very hot. In this section, the rolled stock 2 is cooled only by air. Because of the high temperature of the rolled stock 2, air-cooling is rather effective.

In the middle section 7, a water distribution device 9 is provided. A predetermined quantity of water M under a predetermined working pressure is applied to the rolled stock 2. The water distribution device 9 is formed as a spraying device. Thus, the rolled stock 2 is cooled in the middle section 7 by being sprayed with the predetermined quantity of water M. Thus, the rolled stock 2 is intensively cooled over a temperature range which is harmless as to the microstructure of the rolled stock material.

In the end section 8, the rolled stock 2 is again air-cooled. Simultaneously, because of its residual heat, the rolled stock 2 is air-dried. Finally, a temperature equalization takes place inside the rolled stock 2. The temperature equalization is particularly advantageous for a subsequent straightening of the rolled stock.

In the embodiment shown in FIG. 1, the water distribution device 9 has three rows 10 of spray nozzles 11. The spray nozzle rows 10 can be turned off separately with respective stop valves 12. The stop valves 12 form a width-adjusting device with which an operational width of the middle section 7 is adjusted by separate switching-on of the spray nozzle rows 10. The separate switching of the nozzle rows insures that within design limits of the cooling bed, it is possible to cool down a rolling stock 2 having the largest possible size to a straightening temperature of, e.g., 100°. If necessary, the operational length of the spray nozzle rows 10 can be varied with further stop valves provided within respective rows. The additional stop valves are not shown in the drawings for the sake of clarity.

A pump 13 delivers water from a tank 14 to the water distribution device 9. A flowmeter 15 is arranged between the pump 13 and the tank 14. The output signal of the flowmeter 15 is communicated to a controller 16. The controller 16 controls the operation of the pump 13 in such a way that the actual water quantity W, which is measured by the flowmeter 15, corresponds to a set value M*. The pump 13, the flowmeter 15, and the controller 16 form together a water quantity adjusting means that insure a delivery of a predetermined amount of water to the water distribution device 9. Alternatively or in addition, a working pressure of water which is delivered by the pump 13 to the water distribution device 9 can be measured. In the latter case, instead of the water quantity M or M*, a working pressure of the water would be used as a controlled variable.

As shown in FIG. 2, the spray nozzles 11 are located only beneath the rolled stock 2. Thus, the water is applied to the rolled stock 2 only from beneath. The spray nozzle 11 are so formed that they spray the water in a form of finest water droplets. Thus, the water is not directly sprayed onto the rolled stock 2 but rather is dissipated into the air which surrounds the rolled stock 2. Accordingly, the water is applied to the rolled stock 2 in a form of air-water mixture which passes upward past the rolled stock 2 as a result of heat convection, as shown by arrows in FIG. 2.

Due to a mild cooling from beneath with a continuous removal of heat from the rolled stock 2 and a corresponding temperature equalization, the rolled stock 2 can be transported transverse to its longitudinal axis 3, without the necessity to rotate the rolled stock about its longitudinal axis. Thus, the devices for rotating the rolled stock 2 about its longitudinal axis 3, such as upward pivoting and downward pivoting devices, can be eliminated.

Because of cooling with the water droplets, the cooling bed can be made substantially smaller in a direction transverse to the longitudinal axis 3 than when pure air-cooling is used. The cooling with finest water droplets insures a uniform cooling of the rolled stock 2. Such cooling does not adversely affect the quality of the rolled stock 2 and prevents the rolled stock 2 from twisting. Water droplets having a suitable droplet size can, e.g., be produced by forming the spray nozzles 11 as so-called hollow cone nozzles or by setting the air pressure so that it contributes to water automization.

The inventive cooling method and cooling bed can be used for cooling a rolling stock of different sizes. However, the inventive cooling method and cooling bed proved to be particularly advantageous for medium and heavy steel profiles, and the cooling bed is correspondingly formed. Under medium steel profile is understood a profile with an edge length amounting to 60, 70, 80, 90, and 100 mm. The steel profile with an edge length of 400, 450, 500, 550, and 600 mm relates to the heavy profile. Generally, the steel profile is an arbitrary definition. E.g., T-, I-, or I-, U-, X- and rail profile are examples of different steel profiles.

Accordingly, though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A method of cooling a rolled stock having a longitudinal axis, comprising the steps of providing a cooling bed having an air cooling entrance section, a water cooling middle section, and an air cooling end section; transporting the rolled stock along the cooling bed in a direction transverse to the rolled stock longitudinal axis; air-cooling of the rolled stock in the entrance section of the cooling bed; spray-cooling of the rolled stock in the middle section of the cooling bed by spraying water onto the rolled stock; and air-cooling and air-drying of the rolled stock in the end section of the cooling bed.

2. A method as set forth in claim 1, wherein the step of spray-cooling comprises at least one of adjusting a middle section width, adjusting a quantity of water sprayed onto the rolled stock, and adjusting working pressure of water sprayed onto the rolled stock.

3. A method as set forth in claim 1, wherein the step of spray-cooling includes applying water to the rolled stock only from beneath.

4. A method as set forth in claim 1, wherein the transporting step comprises transporting the rolled stock without rotating the same.

5. A method as set forth in claim 1, wherein the transporting step comprises transporting the rolled stock with a walking beam conveyor.

6. A cooling bed for a rolled stock having a longitudinal axis, comprising an air cooling entrance section, a water cooling middle section, and an air cooling end section extending transverse to the longitudinal axis of the to-be-cooled rolled stock; conveyor means for transporting the rolled stock along the cooling bed starting from the entrance section and across the middle and end sections; and a water distribution device for cooling the rolled stock with water and arranged in the middle section, the water distribution device being formed as a spraying device for producing a water mist.

7. A cooling bed as set forth in claim 6, further comprising, associated with the water distribution device, at least one of a device for adjusting an operational width of the middle section of the cooling bed, a device for adjusting a quantity of sprayed water; and a device for adjusting a working pressure of the sprayed water.

8. A cooling bed as set forth in claim 1, wherein the water distribution device is located beneath the rolled stock.

9. A cooling bed as set forth in claim 6, wherein the conveyor means is formed as a walking beam conveyor.

* * * * *